United States Patent [19]

Anderié

[11] Patent Number: 4,922,631

[45] Date of Patent: May 8, 1990

[54] SHOE BOTTOM FOR SPORTS SHOES

[75] Inventor: Wolf Anderié, Herzogenaurach, Fed. Rep. of Germany

[73] Assignee: Adidas Sportschuhfabriken Adi Dassier Stiftung & Co. KG, Fed. Rep. of Germany

[21] Appl. No.: 298,685

[22] Filed: Jan. 18, 1989

Related U.S. Application Data

[63] Continuation-in-part of Ser. No. 153,082, Feb. 8, 1988.

[51] Int. Cl.[5] ..... A43B 5/00; A43B 13/42

[52] U.S. Cl. ..... 36/102; 36/114; 36/76 R

[58] Field of Search ..... 36/114, 107, 108, 72 A, 36/76 R, 76 C, 30 R, 102, 103

[56] References Cited

U.S. PATENT DOCUMENTS

| | | | |
|---|---|---|---|
| 87,722 | 3/1869 | Stewart | 36/76 R |
| 861,947 | 7/1907 | Brennan | 36/76 R |
| 1,347,061 | 7/1920 | Steinbrecher | 36/76 R |
| 1,628,969 | 5/1927 | Griesedieck | 36/76 R |
| 1,767,801 | 6/1930 | Laible | 36/76 R |
| 1,785,808 | 12/1930 | Cipollina | 36/76 R |
| 2,095,398 | 10/1937 | Reeves | 36/76 |
| 2,832,976 | 5/1958 | Huprich | 36/76 R |
| 2,897,611 | 8/1959 | Schaller | 36/30 R |
| 4,162,583 | 7/1979 | Darrin | 36/76 R |
| 4,404,757 | 9/1983 | Sweeny | 36/76 C |
| 4,542,598 | 9/1985 | Misevich et al. | 36/108 |

FOREIGN PATENT DOCUMENTS

| | | | |
|---|---|---|---|
| 225136 | 5/1958 | Australia | 36/76 R |
| 804901 | 5/1951 | Fed. Rep. of Germany . | |
| 860322 | 12/1952 | Fed. Rep. of Germany . | |
| 1719678 | 3/1956 | Fed. Rep. of Germany . | |
| 943996 | 8/1956 | Fed. Rep. of Germany . | |
| 1973324 | 8/1967 | Fed. Rep. of Germany . | |
| 1485804 | 4/1970 | Fed. Rep. of Germany . | |
| 2130628 | 12/1972 | Fed. Rep. of Germany . | |
| 1581499 | 8/1969 | France . | |

*Primary Examiner*—Steven N. Meyers

[57] ABSTRACT

The shank of a shoe bottom is stiffened by a stiffening member against bending in both directions about first and second axes transverse to the longitudinal axis of the shoe while permitting relative twisting movement of the front and rear sole portions.

15 Claims, 4 Drawing Sheets

FIG.1
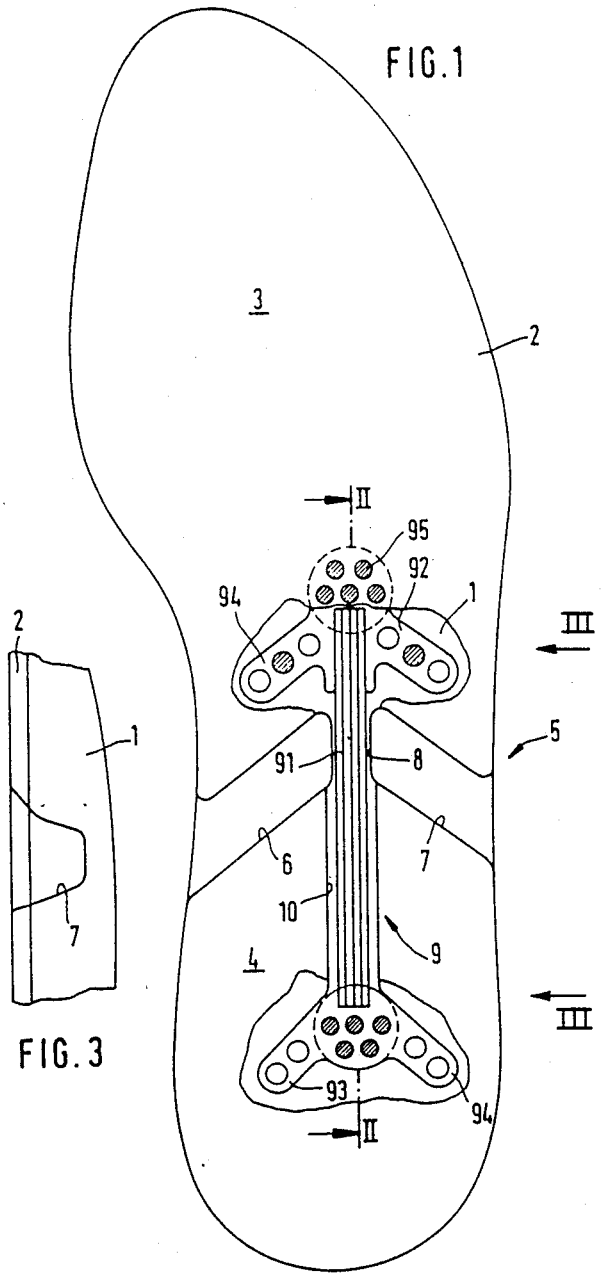
FIG.2
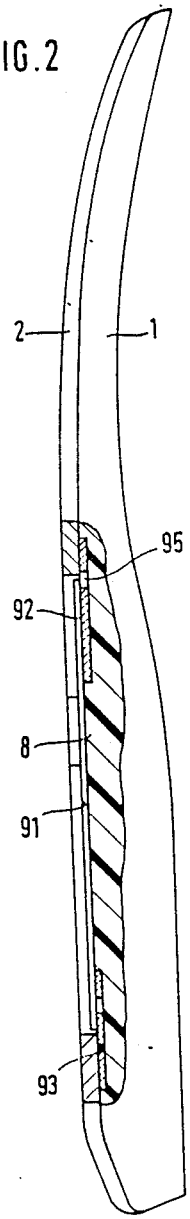
FIG.3

SHOE BOTTOM FOR SPORTS SHOES

The invention relates to a shoe bottom, in particular for sports shoes and is a continuation-in-part application of copending application Ser. No. 153,082 filed 2/8/88.

BACKGROUND OF THE INVENTION

It is known from biomechanics that, in the natural rolling movement of the foot, between the front part of the foot and the heel, approximately in the region of the cuneiform bones, that is to say over the shank of the shoe bottom, there is a twisting action about an axis which extends substantially in the longitudinal direction of the foot. In order to take account of that twisting movement, it is known to provide the shank of the shoe bottom intentionally with weakened locations which permit the front sole portion to twist relative to the rear sole portion about an axis extending substantially in the longitudinal direction of the shoe (German patent specification No. 804 901). Such weak locations are produced by reducing the thickness of the sole or the shoe bottom in the region of the shank thereof, while desirably there still remains a central limb portion extending substantially in the longitudinal direction of the shoe (see German published specification (DE-AS) No. 14 85 804), or it is possible to provide recesses which extend inwardly from the side edge of the shoe bottom and which are filled by means of a filling material which is less stiff (German patent specification No. 943 996).

The weak locations for reducing torsional stiffness in the shank of the shoe bottom necessarily also result in a reduction in the resistance to bending of the shoe bottom about a transversely extending axis. That is also desirable, in accordance with the above-indicated teaching, in which connection it was only proposed that a wedge-like lengthwise sole should be provided to prevent the shoe bottom from wearing out in the shank region of shoes with a heel member (see German utility model No. 17 19 678), insofar as that design also provided the foot with a firm support surface in the shank region. Particularly in the case of sports shoes however it has been found that the twistability or torsional mobility, which is desired in principle, in respect of the front sole portion relative to the rear sole portion, results in inadequate guiding and holding of the foot if the shoe bottom is not only yielding in respect of torsion in the shank region but is also readily bendable in that region, because as a result the foot has an excessive freedom of movement in the region of the metatarsus joints. That makes itself noticeable as a lack of lateral stability particularly when the foot of the runner encounters surface irregularities, which is generally inevitable when rambling or hiking, when running through woods, when jogging and the like.

The invention is therefore based on the problem of providing a shoe bottom of the kind set forth in the opening part of this specification, which ensures that the foot is better guided and held, without adversely affecting the desired torsional decoupling as between the front sole portion and the rear sole portion.

SUMMARY OF THE INVENTION

In accordance with the invention therefore the shank of the shoe bottom is stiffened against bending about an axis extending transversely with respect to the longitudinal direction of the shoe, by stiffening means, in which connection the increased resistance to bending is concerned in particular with a bending movement which occurs as a curvature of the shoe bottom in a convex configuration in a downward direction, that is to say, towards the ground-engaging side of the shoe bottom.

It is particularly advantageous for the stiffening means to be an element which is resistant to tension and which, extending in the longitudinal direction of the shoe, is anchored in the shoe bottom adjacent the ground-engaging side thereof. That element does not need to have any resistance to bending of its own, as the stiffening effect in respect of the shoe bottom is provided by virtue of the non-stretchability or the only very low degree of stretchability of the tension-resistant element and the arrangement thereof beneath the "neutral bending fibre" of the shoe bottom. That has the significant advantage that the element which is resistant to tension and which is for example of a strip-like configuration does not have any torsional stiffness of its own and therefore does not in any way adversely affect the desired twistability of the front sole portion relative to the rear sole portion. Therefore the resistance to bending of the shoe bottom in the shank region may be controlled within wide limits by using such a tension-resistant member, without thereby affecting the torsional stiffness of the shoe bottom in the shank. Another important advantage is that, in comparison with stiffening means which have their own resistance to bending (for example steel shank springs or the like), the stiffening effect by means of the tension-resistant means can be kept substantially lighter, which is an important consideration in relation to sports shoes. There are available materials which are resistant to tension and which are almost non-stretchable, with a high level of strength and of very low weight, for example metal wires, carbon and glass fibres, plastics wires and strip-like elements which are made from such materials.

In a particular embodiment of the invention, it is provided in known manner that the weak locations for reducing the torsional stiffness in the shank of the shoe bottom are recesses which extend inwardly from the edge transversely or inclinedly (being inclined forwardly or rearwardly) and which extend as far as a limb portion of the shoe bottom, which extends in the longitudinal direction of the shoe. The limb portion advantageously extends substantially centrally between the side edges of the shoe bottom. That configuration provides that the element which is strong in respect of tension extends along that limb portion. In that arrangement, with the usual production of the shoe bottom from plastics material, the tension-resistant element may be embedded in the limb portion adjacent to the underside thereof. It is also possible however for the element to be arranged along the free underneath surface of the limb portion, in which case a wearing sole which is fixed to the front sole portion and the rear sole portion ensures that the tension-resistant element does not come directly into contact with the ground. In that way the tension-resistant element is arranged very close to the ground-engaging side of the shoe bottom.

Even if the stiffening means is formed by the above-mentioned tension-resistant element, it can be embedded over its entire length in the shoe bottom so that it is capable over its entire length of transmitting forces with a stiffening effect. That is not necessarily the case however as, both in regard to stiffening means which are resistant to bending and also stiffening means which are only resistant to tension, the important consideration is essentially that the two ends thereof are adequately firmly fixed in the shoe bottom. For that purpose, anchoring inserts are desirably provided at the ends of the stiffening means, the anchoring inserts being fixed in the shoe bottom, for example by being directly embedded therein. The anchoring inserts are of such a configuration that they can resist displacement in the longitudinal direction of the shoe, corresponding to the forces acting thereon when the shoe bottom performs a rolling movement.

Further objects, features and advantages of the invention will be apparent from the following description.

BRIEF DESCRIPTION OF THE DRAWINGS

FIG. 1 is a partly broken-away view from below of an outsole according to the invention, FIG. 2 is a side view of the outsole shown in FIG. 1 partly in section taken along line II—II in FIG. 1, FIG. 3 is a side view of part of the outsole shown in FIG. 1, viewing in the direction indicated by the arrow III.

DESCRIPTION OF PREFERRED EMBODIMENTS

Figure 4:
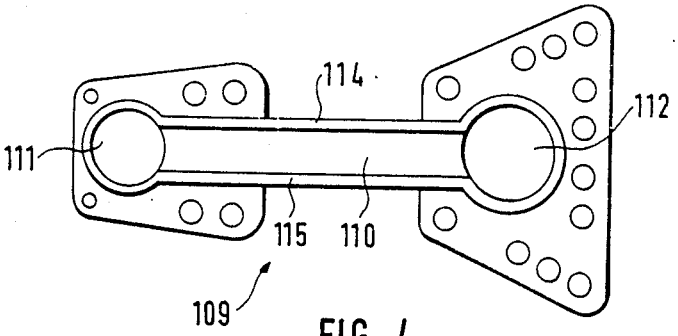
FIG. 4 is a view from below of a stiffening element in a second embodiment of the invention.

The outsole shown in the drawings which, together with an insole (not shown), forms a shoe bottom, essentially comprises an intermediate sole 1 of foamed plastic material, for example polyurethane, and a wearing sole 2 which is arranged at the ground-engaging side and which may be of a profiled configuration. The outsole is subdivided into a front sole portion 3 and a rear sole portion 4 in the shank 5. The sole is subdivided by two recesses 6 and 7 which extend inwardly from the outer and inner edges respectively of the sole, being inclined forwardly and inwardly. As can be seen from FIG. 3, the recesses 6 and 7 extend through the shoe bottom by more than half the height thereof. Between the mutually facing ends of the recesses 6 and 7, the intermediate sole 1 is unaltered in respect of its thickness, thereby providing a central limb 8 which extends substantially centrally in the longitudinal direction of the sole. Due to the recesses 6 and 7, the front sole region 3 is 'decoupled' in respect of torsion, relative to the rear sole portion 4, in other words, the front sole portion 3 can twist relative to the rear sole portion 4 about an axis which extends substantially lengthwise of the central limb 8; that corresponds to the natural movement of the foot when the foot performs a rolling motion, and therefore assists with the rolling motion.

Embedded into the intermediate sole 1 is a stiffening element which is generally indicated by reference numeral 9. The stiffening element 9 comprises plastic wires 91 which are strong in respect of tension and which are low-stretch (for example consisting of nylon) and which are combined in parallel side-by-side relationship to form a flat strip, and anchoring inserts 92 and 93 which are fixed to the ends of the wires 91. The plastic wires 91 which are for example 1.5 mm in diameter are fixedly connected to the anchoring inserts 92 and 93 which are also advantageously made from plastic material, for example by being directly embedded into the anchoring inserts. The plastic wires 91 may also be joined together over their length. The anchoring inserts 92 and 93 are of a plate-like configuration (see FIG. 2) and have lateral leg portions 94. Provided in the anchoring inserts 92 and 93 are openings 95 through which the material of the intermediate sole 1 can pass in the moulding or shaping operation, and thus embed the anchoring inserts in the sole.

As can be seen from FIG. 2, the underside of the central limb 8 along which the plastic wires 91 extend is disposed above the ground-engaging side of the wearing sole 2. In the illustrated embodiment, the wearing sole 2 has an interruption or aperture 10 in which the plastic wires 91 are exposed, in both portions of the sole, namely in the front sole portion 3 and in the rear sole portion 4. That ensures that the strip formed by the plastic wires 91 is not prevented from assuming a curved configuration, in the event of a torsional movement of the front sole portion 3 relative to the rear sole portion 4. The aperture 10 is not necessary however; it is entirely possible for the stiffening element 9 and in particular the plastic wires 91 to be completely covered by the wearing sole 2, in order to protect the wires 91 from damage.

It will be seen from the foregoing description that the resistance to bending of the outsole about a transverse axis extending perpendicularly to the central limb 8 can be controlled by the resistance to tensile stretching of the stiffening element 9. If the resistance to bending of the sole is to be increased, it is possible to envisage increasing the number of plastic wires 91 and therewith the width of the strip formed thereby. In the principle it is also possible to envisage increasing the thickness of the plastic wires, but care should be taken to avoid increasing the torsional stiffness of the shoe bottom in the shank region thereof, by an increase in the thickness of the wires.

It will be appreciated that, instead of the plastic wires 91 described in the illustrated embodiment, it is also possible to use other stiffening means which are resistant to tension. Thus, it is possible to envisage providing, by means of the anchoring inserts 92 and 93, a mesh, netting or cloth of glass or carbon fibres, which is of a strip-like configuration and which is embedded in the sole in a similar manner to that described above. By choosing the width of the strip formed by such a cloth, it is possible to control within wide limits the tensile strength and thus the resulting bending strength, without noticeably affecting the weight of the shoe bottom. However, also included within the scope of the invention is the arrangement of flat metal strips which, by virtue of being small in thickness, have a correspondingly low level of bending strength while however having considerable tensile strength.

Referring now to FIGS. 4 through 8, shown therein is a practical embodiment of a stiffening element which in accordance with the principles of the present invention is arranged in the shank region of an outsole and stiffens same in respect of a bending movement both towards the side and upwardly, while however retaining the desired twistability or torsional mobility of the front sole portion relative to the rear sole portion.

Figure 5:
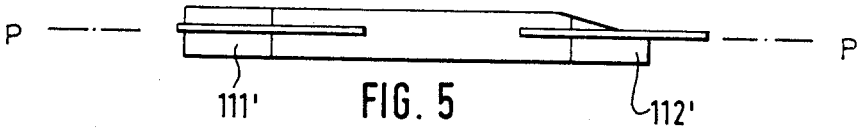
FIG. 5 is a side view of the stiffening element shown in FIG. 4.
Figure 6:
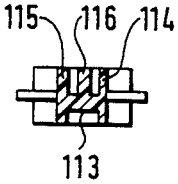
FIG. 6 is a view in cross-section taken along line VI—VI in FIG. 8.
Figure 7:
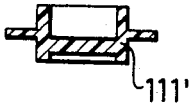
FIG. 7 is a view in cross-section taken along line VII—VII in FIG. 8.

For that purpose, the stiffening element which is generally indicated by reference numeral 109 in FIG. 4 comprises an elongate bar 110 which in practice is for example about 9 cm in length. The two ends 111 and 112 of the bar 110 are terminated by enlarged portions of a circular configuration. The bar 110 is entirely straight and is of the cross-sectional configuration shown in FIG. 6, between the end portions 111 and 112. Accordingly, the bar 110 comprises a horizontally extending flat portion 113 and vertical limb portions 114 and 115 which are joined to the mutually oppositely disposed longitudinal edges of the flat portion 113 in such a way that the limb portions 114 and 115 project beyond the top side and the underside of the flat strip portion 113 of the bar 110. The limb portions 114 and 115 project further upwardly than downwardly by a factor of about 2 to 2.5 times, while extending substantially centrally therebetween is a third parallel limb portion 116. The outer limb portions 114 and 115 each blend in the circular end portions 111 and 112 into respective circular annular walls 111' and 112' respectively, as indicated in FIGS. 5 and 7, which extend around the end portions 111 and 112. With the exception of the upwardly extending part of the annular wall 112' which is bevelled or chamfered to about half the height of the outer limb portions 114 and 115 in the manner shown in FIG. 5, the limb portions 114 and 115 and the walls 111' and 112' adjoining same are of a constant height in the upward and downward directions. The central limb portion 116 terminates at the end portions 111 and 112.

Figure 8:
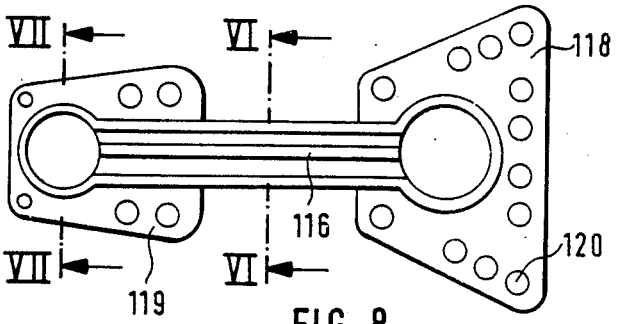
FIG. 8 is a view from above of the stiffening element shown in FIGS. 4 through 7.

At positions corresponding to the halfway point in respect of the height of the limb portions 114 and 115 and the annular walls 111' and 112', that height in the practical embodiment illustrated being about 8 mm, generally plate-shaped anchoring inserts 118 and 119 project outwardly therefrom. The anchoring inserts 118 and 119 are of an approximately trapezoidal configuration as shown in FIGS. 4 and 8 and have perforations as indicated at 120 in FIG. 8. The thickness of the anchoring inserts 118 and 119 is about 1 mm (see FIG. 5). The anchoring inserts 118 and 119 extend in part along the bar 110, thereby affecting the torsional mobility of the bar 110, as will be apparent hereinafter.

In the illustrated embodiment the stiffening element 109 comprises a plastic material which is resilient in respect of bending and torsion but which exhibits little compression deformability, for example polyamide which is set hard. It is also possible to use other plastic materials, for example polyurethane, which are of adequate strength to produce the required stiffening effect but which are sufficiently resilient in respect of bending and torsion to permit a twisting action about the longitudinal axis of the bar 110. In the illustrated embodiment the stiffening element 109 is produced by an injection moulding procedure; although not shown in the drawings, it can be stiffened in the limb portions 114 and 115 by means for example of glass or carbon fibres.

Figure 9:
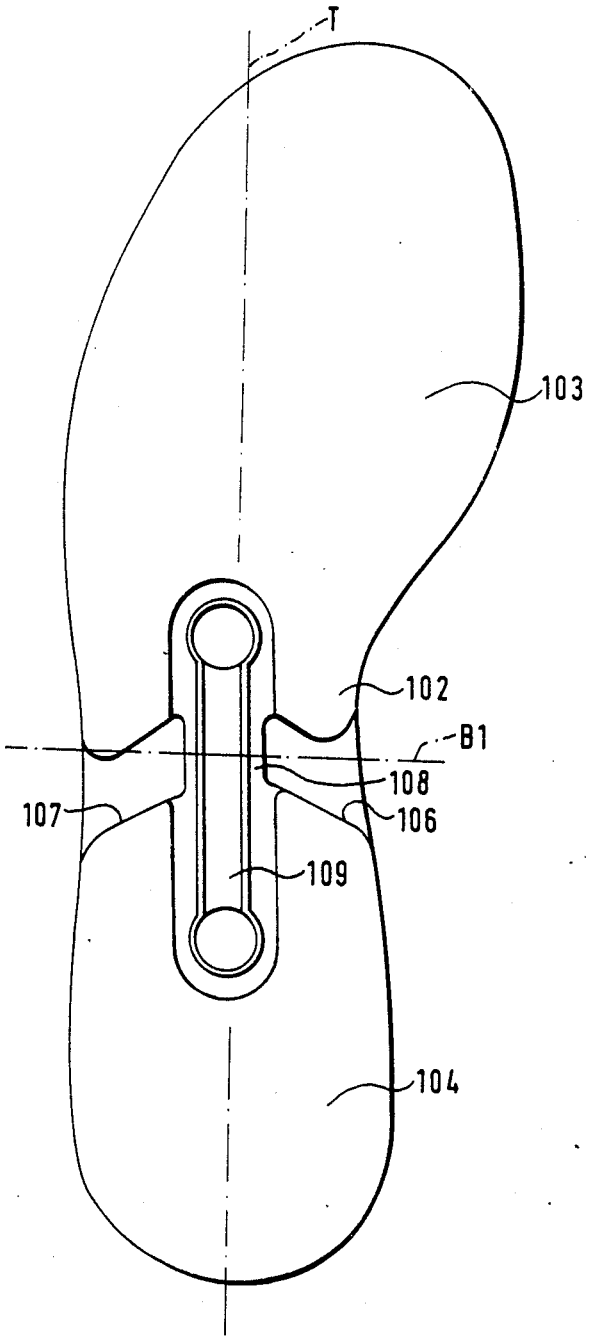
FIG. 9 is a diagrammatic view from below of an outsole according to the invention in which the stiffening element shown in FIGS. 4 through 8 is embedded.
Figure 10:
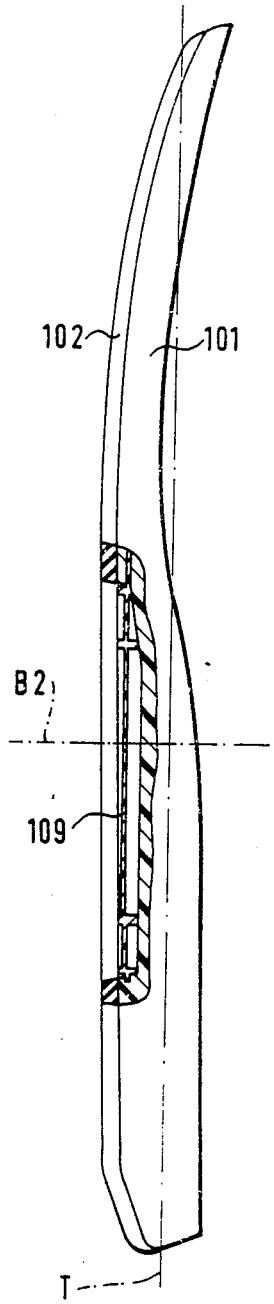
FIG. 10 is a partial side view of the outsole shown in FIG. 9, viewed along line X—X in FIG. 9.

Reference will now be made to FIGS. 9 and 10 showing an outsole in accordance with the invention which, in terms of its basic configuration, corresponds to that shown in FIGS. 1 through 3. However in this case the stiffening element 109 is integrated in the outsole. The longitudinal axis T of the outsole is shown in dash-dotted lines in FIGS. 9 and 10. The longitudinal axis T may be disposed at a position at any height in respect of the sole, but FIG. 10 shows it in a position which approximately corresponds to what is referred to as the 'neutral bending fibre' of the shank region.

As in the embodiment shown in FIGS. 1 through 3, the outsole shown in FIGS. 9 and 10 also has weak locations in the shank region, being formed by recesses 106 and 107 which extend inwardly from the side edges of the outsole. The height or depth of the recesses corresponds to that shown in FIG. 3. The recesses 106 and 107 define a central limb 108 which extends substantially in the direction of the longitudinal axis T of the outsole and into which the stiffening element 109 of FIGS. 4 through 8 is so embedded that the bottom edges of the respective lateral limb portions indicated at 114 and 115 in for example FIG. 4 lie just flush with the underneath surface of the central limb 108, as can be seen from FIG. 10.

The anchoring inserts 118 and 119 are embedded in the front sole portion 103 and the rear sole portion 104 respectively, with the plastic material of the outsole passing through the perforations 120 in the inserts 118 and 119. The bevelled or chamfered configuration of the upper part of the annular wall 112' as described above with reference to FIG. 5 prevents the annular wall 112' pressing through the sole upwardly towards the foot in the front sole portion 103 which is of smaller thickness, which would otherwise have an adverse effect on the comfort of wearing the shoe.

It will also be seen from FIG. 9 that the straight bar 110 of the stiffening element 109 extends substantially along the longitudinal axis T of the outsole, while FIG. 10 shows that the stiffening element 109 is disposed adjacent to the ground-engaging side of the outsole 102 and in any event beneath the neutral bending fibre (longitudinal axis T).

FIGS. 9 and 10 also show in dash-dotted lines first and second bending axes B1 and B2 which extend transversely with respect to the longitudinal axis T. The bending axis B1 extends perpendicularly to the longitudinal axis T and substantially parallel to the ground-engaging side of the outsole 102 while the bending axis B2 also extends perpendicularly to the longitudinal axis T but perpendicularly to the ground-engaging side of the outsole.

By virtue of the above-described and illustrated arrangement of the stiffening element, it stiffens the bottom of the shoe formed by the intermediate sole 101 and the wearing sole or outsole 102, relative to a bending effect about the transversely extending bending axes B1 and B2 so that the foot of the person wearing the shoe is firmly supported and guided in the rolling motion of the foot. The stiffening element resists bending in both directions about axes B1 and B2. A critical consideration in regard to the stiffening effect about the bending axis B1 is the point that the strip portion 113 of the stiffening element 109 which can carry considerable tensile forces without noticeable stretching occurring is disposed at a relatively large spacing on the ground-engaging side from the above-mentioned neutral bending fibre (longitudinal axis T in FIG. 10). The upright limb portions 114, 115 and 116 of the stiffening element also make up a considerable part of the stiffening effect.

In that connection the plate-shaped anchoring inserts 118 and 119 which are of large surface area, and the circular end portions 111 and 112 of the stiffening element 109, prevent the ends of the bar 110 from being locally pressed upwardly or downwardly into the intermediate sole 101 so that the stiffening effect of the stiffening element 109 can take full effect.

The stiffening effect about the bending axis B2, that is to say in the transverse direction of the outsole, is decisively determined by the moment of surface inertia of the strip 113, which is comparatively great in relation to the bending axis B2, in conjunction with the limb portions 114 and 115 (in practice the width of the bar 110 is about 12 mm).

In spite of the above-discussed stiffening effect in respect of bending about the bending axes B1 and B2 the stiffening element 109 is comparatively yielding in respect of torsion about the longitudinal axis of the bar 110 which thus defines the torsional axis. The aspect which is important in that connection is that the bar 110 of the stiffening element 109 forms what can be referred to as an open profile which, in contrast to a closed profile such as for example a hollow rectangular profile, affords a comparatively low level of torsional stiffness, while having a high level of bending stiffness. Another aspect of significance in that connection however is that, unlike the torsional stiffness of the stiffening element 9 in the embodiment shown in FIGS. 1 through 3, which is very low even over major angles of twisting movement, the stiffening element 109 opposes a considerable resistance to further twisting as from an angle of twisting of about 60°, and thereby also contributes to stabilising and supporting the foot of the wearer of the shoe. For, the twisting motion as between the forefoot and the rear foot in the natural rolling motion of the foot is within the above-mentioned limit angle of about 60°.

Figure 11:
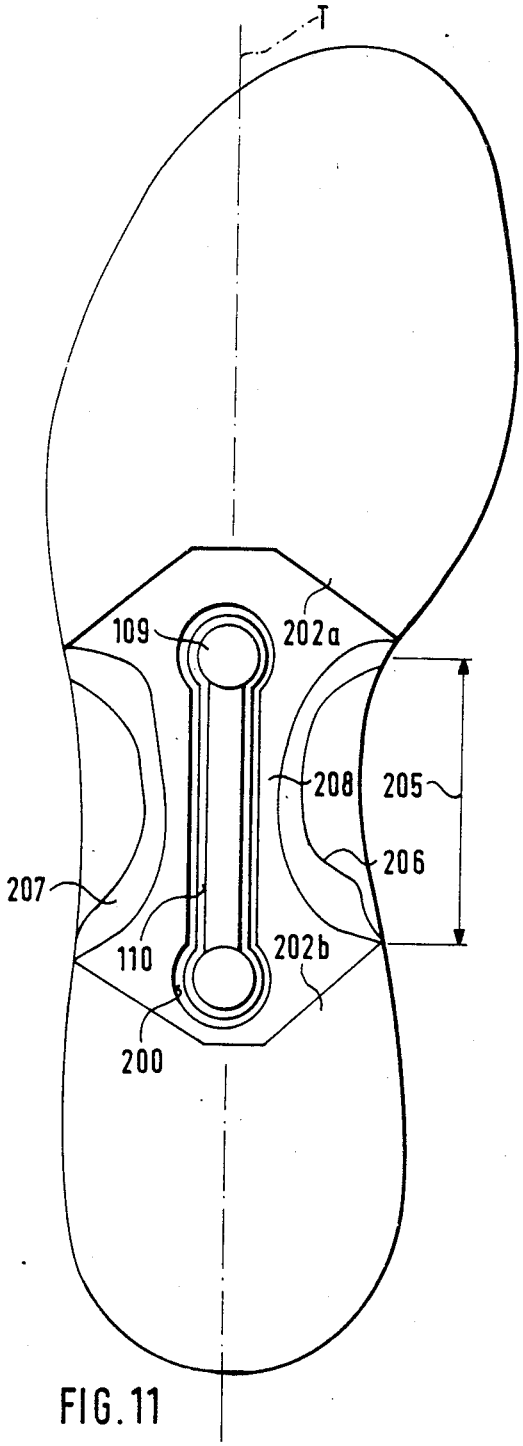
FIG. 11 is a diagrammatic view from below of a further outsole according to the invention in which a stiffening element as shown in FIGS. 4 through 8 is embedded.
Figure 12:
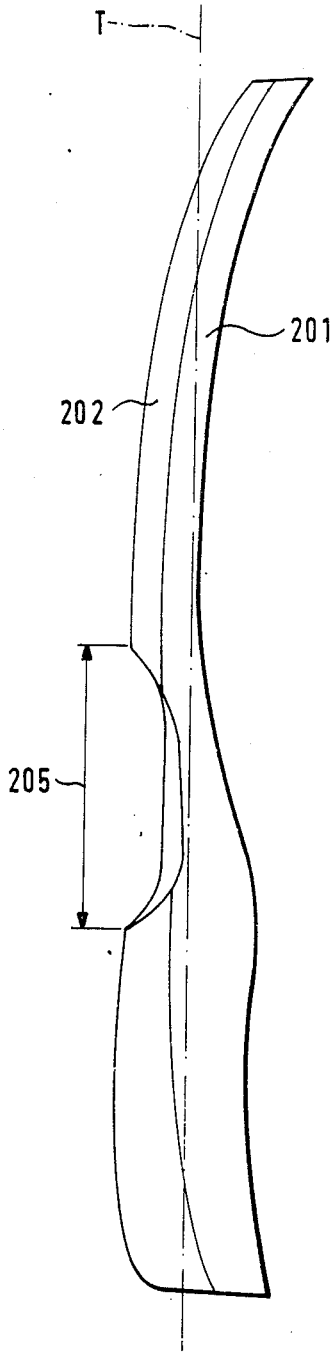
FIG. 12 is a side view of the outsole shown in FIG. 11.

Reference will now be made to FIGS. 11 and 12 showing an embodiment of an outsole according to the invention which differs from that shown in FIGS. 9 and 10 insofar as in the shank region 205 the wearing sole or outsole 202 is subdivided into a front sole porton **202*a* and a rear sole portion 202*b* so that, by virtue of that configuration, the shank region 205** itself does not have any surface, referred to as a ground-engaging surface, which comes into contact with the ground.

The weak locations which are provided in the shank region 205 are formed in the same manner as in the embodiment described above by means of lateral recesses 206 and 207 which in this embodiment however extend over the entire length of the shank region 205. At the edges of the lateral recesses 206 and 207, the intermediate sole 201 is bevelled or chamfered downwardly, as can be seen from FIG. 11. The recesses 206 and 207 again define a central limb 208, along the underside of which the stiffening element 109 is arranged to extend in the direction of the longitudinal axis T of the sole. The underside of the central limb 208 has a recess 200 which is adapted to the outline configuration of the bar 110 including the end portions thereof which are enlarged in a circular configuration, although the recess 200 is slightly largely than the bar 110. The underside of the bar 110 is exposed in the recess 200 and, as in the case of the embodiment described hereinbefore with reference to FIGS. 9 and 10, is embedded to such a depth than the underside of the central limb 208 is just flush with the bottom edges of the longitudinally extending limb portions indicated at 114 and 115 for example in FIG. 4. By virtue of that arrangement, the lower parts of the longitudinal limb portions 114 and 115 project slightly from the bottom of the recess 200, namely by an amount which approximately corresponds to the distance by which the longitudinal limb portions 114 and 115 project downwardly beyond the strip portion indicated at 113 in FIG. 6, on the bar 110.

It will be appreciated that the above-described embodiments of the invention have been set forth solely by way of example and illustration thereof and that various modifications and alterations may be made therein without thereby departing from the spirit and scope of the invention. Thus, in relation to the embodiments shown in FIGS. 4 through 12, there is no absolute necessity for the lateral limb portions 114 and 115 of the stiffening element 109 to project downwardly and upwardly beyond the flat strip portion 113. On the contrary it is also possible to adopt a configuration in which the flat strip portion 113 is flush with the bottom edges of the lateral limb portions 114 and 115. The central limb portion 116 is also not absolutely necessary. Thus, instead of the cross-sectional configuration shown in FIG. 6, the bar 110 may also be of a configuration in cross-section corresponding to that of a U or a H.

Further it is to be noted that the plastic material which the stiffening element 109 is made of must not necessarily be of the same type throughout in the stiffening element. That is, as indicated by the dash-dotted line P—P in FIG. 5 which represents a plane substantially coplanar with the lower surface of the plate-shaped anchoring inserts 118, 119, the stiffening element 109 may comprise two plastics materials above and below said plane P—P and integrally connected therealong. The plastics material above said plane P—P may be relatively hard, e.g. polyamide, which is stabilizing and stiff against bending in the sense explained above. The plastics material below said plane P—P may be softer and more yielding than the upper plastics material and may be particularly resistant against wear, e.g. polyurethane. Thus the stiffening element 109 may be a composite body of which the elastic properties can be predetermined according to the type of plastic materials used for the respective portions above and below said plane P—P. As stated above, said plane P—P can be substantially coplanar with the upper surface of the plate-shaped anchoring inserts 118, 119 and thus these inserts will be made of the harder plastics material for stabilizing purposes. It will be appreciated, however, that the position of the plane can be higher or lower depending on the combination of torsional yielding and bending stiffness which is aimed at. Thus, if a torsional limit angle of more than 60° is to be warranted, the plane P—P may be positioned higher than the plate-shaped anchoring inserts 118, 119 thus rendering the stiffening element 109 more yielding with respect to torques acting upon it.

Finally it will be appreciated that the dimensions of the stiffening element 109 of this particular embodiment may be changed. Thus the length of the bar 110, which has been stated to be 9 cm in this particular embodiment, will change from 6 to 10,6 cm depending on whether it is determined for the smallest size of a children's shoe or the largest size of an adult's shoe. It will be understood that, particularly for an adult's shoe, with increasing length of the bar 110 the width and thus the cross sectional dimensions thereof will increase, too.

What is claimed is:

1. A shoe, in particular a sports shoe, comprising an shoe bottom having a top side and an underside and providing a front sole portion, a rear sole portion and a shank portion joining said front and rear sole portion and having oppositely disposed lateral edges, wherein at least the front sole portion and the rear sole portion have a ground-engaging side, the ground-engaging sides being at least approximately disposed in a common plane, with a longitudinal axis extending substantially in the longitudinal direction of the sole and substantially centrally between said oppositely disposed lateral edges of the shank portion, and first and second transverse axes in the shank portion which extend transversely with respect to said longitudinal axis, one said transverse axis being disposed substantially perpendicularly to said plane and the other said axis being disposed substantially parallel to said plane, torsion stiffness reducing means in the shank portion for reducing the torsional stiffness of the shank portion about said longitudinal axis to permit a relative twisting movement of the front sole portion and the rear sole portion about said longitudinal axis, and comprising in the shank portion a stiffening element in the form of a straight bar of elastically deformable material having first and second ends and extending substantially along said longitudinal axis and provided at each of its ends with plate-like anchoring inserts anchored in the front sole portion and the rear sole portion respectively, the bar comprising a flat strip portion having oppositely disposed lateral edges and extending substantially parallel to said plane and upstanding limb portions extending along said lateral edges of the strip portion and connected to same wherein the stiffening element provides for stiffening of the shank portion against bending in both directions about said first and second transverse axes while at the same time permitting said relative twisting movement of the front and rear sole portions.

2. A shoe as claimed in claim 1 wherein said strip portion of said bar is disposed more closely adjacent to the underside of the shoe bottom than to the top side thereof.

3. A shoe as claimed in claim 1, wherein the bar forming the stiffening element in the shank portion is arranged adjacent the underside of the shoe bottom.

4. A shoe as claimed in claim 3 wherein the strip portion has an underneath surface and the bar is so embedded in the shank portion that the underneath surface of the strip portion is exposed.

5. A shoe as claimed in claim 4 wherein the underside of the shoe bottom is provided in the shank portion with a ground-engaging side which is disposed substantially in said plane and has a cavity, the underneath surface of the strip portion when in said captivity being exposed and being displaced relative to said plane towards the top side of the shoe bottom.

6. A shoe as claimed in claim 4 wherein the stiffening element is embedded into the central limb.

7. A shoe as claimed in claim 1 wherein the strip portion of the bar has an upper surface and a lower surface and the limb portions project beyond the upper surface and the lower surface respectively.

8. A shoe as claimed in claim 7 wherein the limb portions project further beyond the upper surface than the lower surface.

9. A shoe as claimed in claim 8 wherein the bar is so embedded in the shank portion that the underneath surface of the strip portion is exposed.

10. A shoe as claimed in claim 9 wherein the underside of the shoe bottom is provided in the shank portion with a ground-engaging side which is disposed substantially in said plane and has a cavity, the underneath surface of the strip portion when in said cavity being exposed and being displaced relative to said plane towards the top side of the shoe bottom.

11. A shoe as claimed in claim 9 wherein the stiffening element is embedded into the central limb.

12. A shoe as claimed in claim 7 wherein in addition to said limb portions a third upright limb portion is connected to at least one of said upper and lower surfaces and extends between and in parallel relationship with said first-mentioned limb portions.

13. A shoe as claimed in claim 12 wherein said limb portions project further beyond the upper surface than the lower surface.

14. A shoe as claimed in claim 1 wherein said torsion stiffness reducing means are recesses which extend inwardly from said edges of the shank portion transversely or inclinedly and which extend to a central limb extending substantially in the longitudinal direction of the shoe, the stiffening element extending along the central limb.

15. A shoe as claimed in claim 14 wherein said recesses extend substantially over the length of the shank portion.

* * * * *

UNITED STATES PATENT AND TRADEMARK OFFICE

CERTIFICATE OF CORRECTION

PATENT NO. : 4,922,631

DATED : May 8, 1990

INVENTOR(S) : Wolf Anderlie

It is certified that error appears in the above-identified patent and that said Letters Patent is hereby corrected as shown below:

Title page:

[73] adidas Sportschuhfabriken Adi Dassler Stiftung & Co. KG

Signed and Sealed this

Twenty-eighth Day of April, 1992

*Attest:*

HARRY F. MANBECK, JR.

*Attesting Officer*

*Commissioner of Patents and Trademarks*